United States Patent [19]

Buettner

[11] 4,354,065

[45] Oct. 12, 1982

[54] MINIATURE HEARING AID

[75] Inventor: Gerhard Buettner, Grossenseebach, Fed. Rep. of Germany

[73] Assignee: Siemens Aktiengesellschaft, Berlin & Munich, Fed. Rep. of Germany

[21] Appl. No.: 151,766

[22] Filed: May 21, 1980

[30] Foreign Application Priority Data

Jun. 22, 1979 [DE] Fed. Rep. of Germany ... 7918029[U]

[51] Int. Cl.[3] ..... H04R 25/02

[52] U.S. Cl. ..... 179/107 H

[58] Field of Search ..... 179/107 R, 107 E, 107 H, 179/107 S, 178, 179

[56] References Cited

FOREIGN PATENT DOCUMENTS 1147264 4/1963 Fed. Rep. of Germany ..... 179/179
7831808 4/1980 Fed. Rep. of Germany .
1006212 9/1965 United Kingdom ..... 179/107 E
1111887 5/1968 United Kingdom ..... 179/107 R

*Primary Examiner*—George G. Stellar
*Attorney, Agent, or Firm*—Hill, Van Santen, Steadman, Chiara & Simpson

[57] ABSTRACT

In an exemplary embodiment, a two-part housing for the microphone, ear piece receiver and battery, also serves to contain an amplifier. The disclosure provides a fastening of the amplifier which is effective in a simple manner and without additional space requirements in that the elements of the amplifier are arranged distributed on a plurality of plates which rest against spacer support projections at the walls of the housing. The disclosed supporting projections, which hold the plates of the amplifier when the housing is put together, are particularly suited for use in miniature hearing aids which are worn on the head.

4 Claims, 7 Drawing Figures

MINIATURE HEARING AID

BACKGROUND OF THE INVENTION

The invention relates to a miniature hearing aid which is worn on the head and which, in addition to microphone and ear piece as well as battery, also contains an amplifier between two parts of its housing, said amplifier being fastened by means of fixing devices.

In hearing aids to be worn on the head, such as in-ear, behing-the-ear hearing aids or hearing aid glasses, one has no choice but to exploit the mounting space very rationally. Thereby, all possibilities are employed to arrange the sound transducer, amplifiers and other required components, such as energy sources, in such manner that the smallest possible use of space is obtained.

In known devices, the amplifier components are situated on two mounting planes (plates) which are rigidly connected to one another. Such a rigid arrangement can cause difficulties upon insertion into the housing if even the slightest deviations from the standard dimensions exist. Therefore, an amplifier was proposed whose elements are attached on two planes that have a flexible connection to one another. Such an arrangement, however, must be rigidly fixed in the housing in order to avoid a mechanical overload of the solder locations of movable parts such as, for example, those of flexible connections, potentiometers, switches, adjustment means, current supply contacts and pigtails of microphone and ear piece receiver.

SUMMARY OF THE INVENTION

The object of the invention, given a miniature hearing aid according to the generic part of claim 1, is to specify an attachment of the amplifier in the housing which is effective in a simple manner and without additional means. This object is inventively achieved by means of the features cited in the characterizing part of claim 1.

By applying spacer support projections to the walls of the housing, a secure support of the amplifier when the housing parts are closed without additional support means being required. The projections can be applied without a significant space requirement as gradations or ledges on the walls of the housing parts (shells) and exhibit support surfaces which determine the position of the plates on which the components of the amplifier are put in place. The edge of each of the plates is to be provided with recesses such that the projections of the other plate pass through the recesses; also for each respective point of support, projections are to be provided in the first and second part of the housing which engage at the plates when the two parts are put together as interacting support mounts. It is expedient to undertake a three-point support of each plate since a secure support can be thereby achieved in a simple manner. Thereby, protective screw connections can also be provided. On the other hand, in addition to the spacing mount between the plates of the amplifier, a support against lateral displacement of the plates can be achieved when this and the supporting projections for the respectively other plate engage in one another. Expediently, the support of the battery can also be employed as a spacer support in that it is inserted between the plates. Due to the fixing of the plates of the amplifier, it is also possible to rigidly attach the current supply contacts to the printed circuit boards of the amplifier.

In the following, further advantages and details of the invention are explained on the basis of the exemplary embodiments illustrated in the Figures of the accompanying drawing sheets; and other objects, features and advantages will be apparent from this detailed disclosure and from the appended claims.

DETAILED DESCRIPTION

Figures 1, 2:
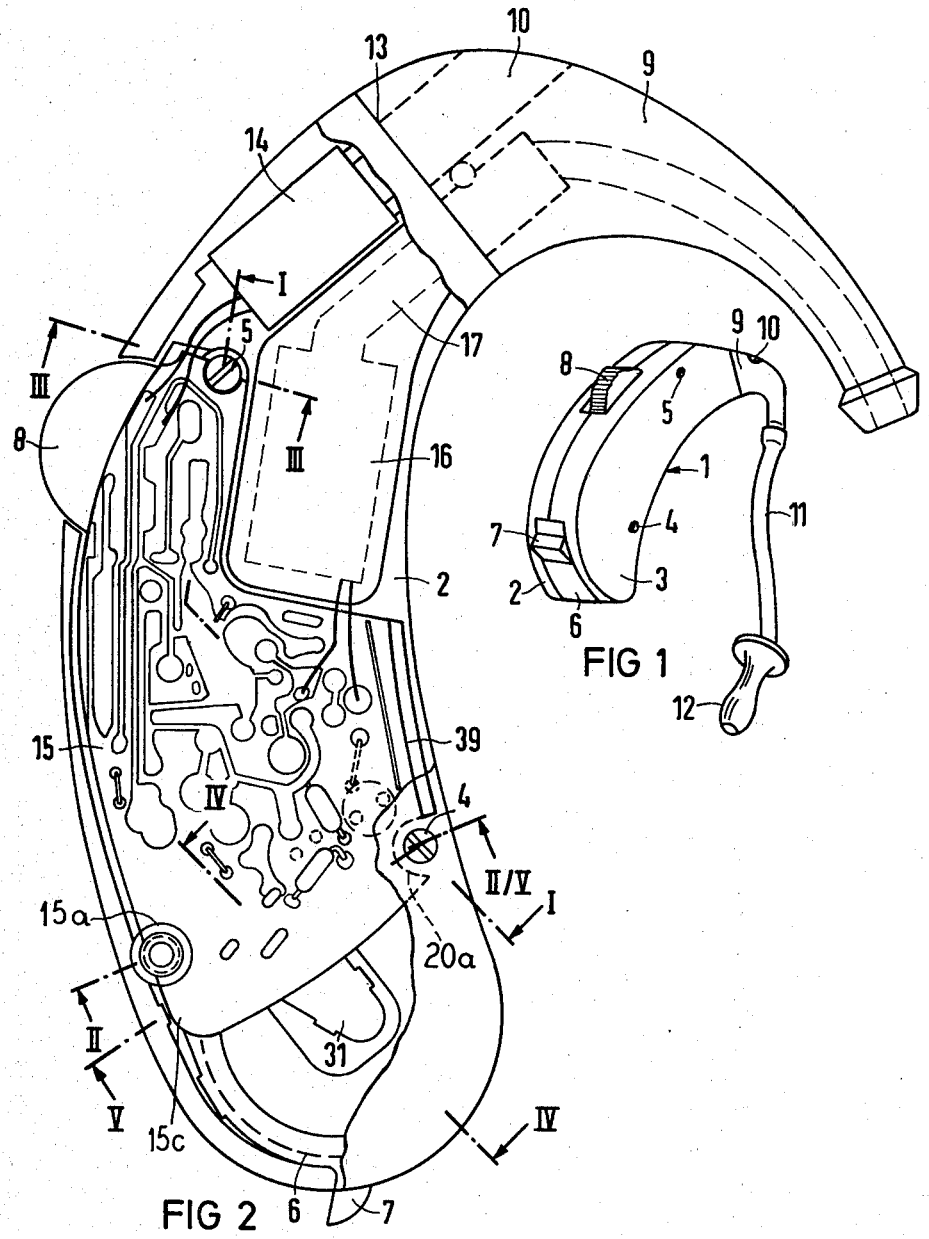
FIG. 1 shows a perspective exterior view of an inventive hearing device provided with an amplifier, which device is to be worn behind the ear.
FIG. 2 is an enlarged plan view of the device of FIG. 1, with an outer wall partly broken away to shown interior parts.

In FIG. 1, 1 indicates a housing composed of shells 2 and 3 which are held together with screws, those referenced with 4 and 5 being visibile in FIG. 1. A battery drawer 6 which can be swiveled out at a handle 7 is visible at the lower end of the housing 1. Moreover, a small wheel 8 with which the loudness of the device can be set is visible at the curved back of the housing 1. A carrying hook 9 is arranged at the upper end of the housing 1, said carrying hook 9 exhibiting a speaking aperture 10 and at whose end a flexible tube 11 is attached which ends in an elastic olive-button 12 which can be introduced into an auditory canal.

In the plan view of FIG. 2, it can be seen that, proceeding from the support surface 13 of the carrying hook 9, there are situated a microphone 14, an amplifier of which one mounting plate 15 is visible, and the battery drawer 6; moreover, allocated to the support surface, an ear piece receiver 16 from which a sound diverter 17 leads to the olive button 12 via the hook 9 and the flexible tube 11. These parts render possible the standard functions in behind-the-ear devices, in which sound enters the microphone 14 through the speaking aperture 10, the sound being converted in said microphone into electrical signals which are supplied to an ear piece receiver 16 amplified by means of the energy taken from the battery housed in the battery drawer 6, a re-conversion into acoustic signals ensuring in said ear piece receiver 16 and these signals then being supplied to the flexible tube 11 and the olive-button 12 via the line 17 and through the hook 9.

The inventive support mount of the amplifier plate 15 and the plate 18 completing the amplifier ensues via projections attached to the insides of the two shells 2 and 3. These projections, as indicated, for instance, at the screw 4, can be a column 19 attached to and integral with the bottom shell 2, a battery drawer 6 put in place on said column 19 and a projection 20 integral with the shell 3, and a column 21 standing at the screw 5 in the bottom shell and a projection 22 integral with the shell 3. A column 24 built up in the shell 3 exists at the screw 23, FIG. 4 (not visible in the perpsective illustration according to FIG. 1) guided through the bottom shell 2, said column 24 having a projection 25 allocated to it which is integral with the bottom shell 2 as a counter-support. As can be seen, for instance, from FIGS. 5 and 7, the support mounts can also be extensions or cut-outs from the support shells 2 and 3 as indicated for instance in FIG. 5 by means of an extension of the inside of the sidewall of shell 3 which is referenced with 26, or a ledge 27 as is indicated in the bottom shell 2. A counter piece is visible in FIG. 7 as an extension 28 of the shell 2 and ledge 29 of the shell 3.

Figure 3:
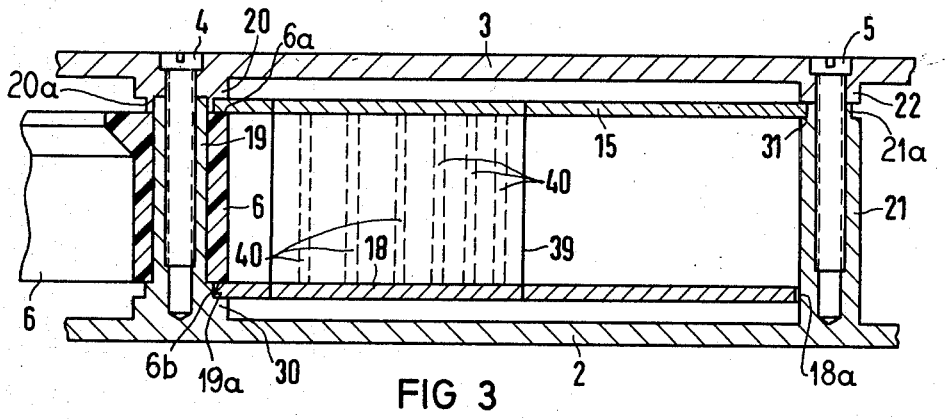
FIG. 3 shows a cross-section taken along line I—I in FIG. 2.
Figure 4:
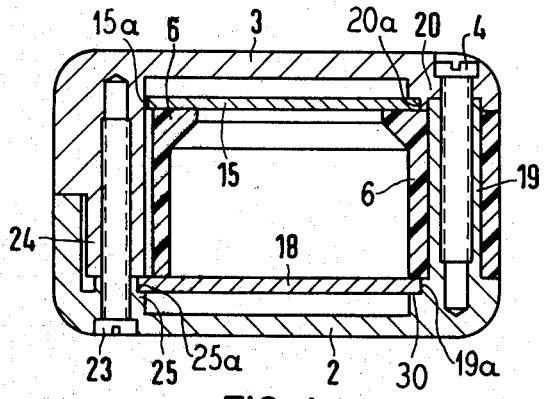
FIG. 4 shows a cross-section along line II—II in FIG. 2.

In the sectional view along I—I according to FIG. 3, it can be seen that the printed circuit board 18 of the amplifier rests in the bottom shell 2 against a foot 30 of column 19 which is broadened step-like and is fixed by the battery drawer 6 seated thereon, the printed circuit board 15 of the amplifier lying at the top on said battery drawer 6 as viewed in FIG. 3, said printed circuit board 15 being held by the projection 20 of the upper shell 3 when the screw 4 is screwed into the column 19. A similar support of the upper circuit board 15 of the amplifier is achieved at the screw 5 in that the column 21 exhibits a gradation or shoulder 31 at its upper end on which the circuit board 15 is put in place and then fixed by means of the projection 22 and the screw 5. The illustration according to FIG. 4 represents a view at the screw 4 at right angles to that according to FIG. 3. The position of the screw 23 can also be seen there, being screwed into a column 24 at whose lower and the printed circuit board 18 is clamped against the bottom shell between the projection 25 and column 24. Thereby the printed circuit board 15 is not as wide as the printed circuit board 18 at the location at which it rests against the column 24, so that the column 24 can extend past board 15 in order to rest against board 18. The support mount at the screw 5 between the extension 26 of the sidewall of the shell 3 and the projection 27 in the bottom shell 2 ensues in an analogous manner.

Figure 6:
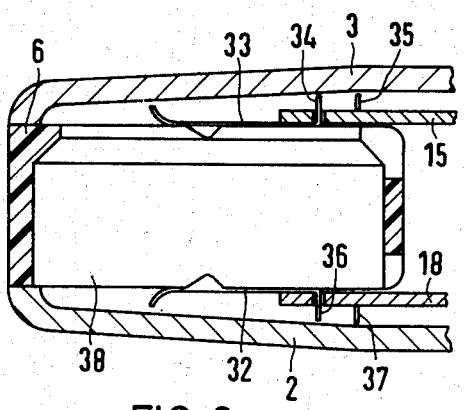
FIG. 6 shows a cross-section along line IV—IV of FIG. 2.

The attachment of current supply contacts 32 and 33 can be seen in FIG. 6, said contacts being soldered to the printed circuit boards 15 and 18 by means of bent parts 34, 35 and 35, 37. Thus, the supply of current ensues at the poles lying at opposite sides of a battery 38. The battery 38 can be swiveled out of the housing 1 at the column 19 by means of the holder 6, as indicated by broken lines in FIG. 1, so that it can be moved, i.e., replaced, etc., in a known manner.

In FIGS. 1 and 3, 39 indicates a flexible connection of the two plates 15 and 18. The electrical lines between the circuit elements of plates 15 and 18 can be conducted via the connection as printed circuit tracks 40 which are indicated by dash lines.

It will be apparent that many modifications and variations may be effected without departing from the scope of the novel concepts and teachings of the present invention.

The German utility model application No. G 78 31 808.8 of the present applicant, which was filed in Germany on Oct. 25, 1978 is now GM 78,31808, registered Apr. 3, 1980, and this German Utility model patent is hereby incorporated herein by reference. The incorporated disclosure shows further details of a miniature hearing aid of the type shown in FIG. 1, and in which the amplifier components are situated on two mounting plates which are connected by means of a flexible connection extending between a corresponding side of each plate (coresponding to the flexible connection 39 of the plates 15 and 18 as viewed in FIG. 3 of the present case). As shown in the incorporated disclosure, the lower plate 18 of the present case may be substantially coextensive with the upper plate 15.

According to the present embodiment, the lower plate 18 may be notched in the vicinity of screw 4, FIG. 3, so as to receive a notched annular part 19*a* of post 19 in conforming relation thereto, essentially as indicated at 20*a* in FIG. 2 for upper plate 15. The portion of the lower plate 18 in the vicinity of screw 23, FIG. 4, may have a segmental circular notch conforming with annular projecting boss 25*a* of projection 25, so that, for example, the lower plate 18 encircles more than 180° of the boss 25*a* in the same way as indicated for upper plate 15 at 15*a* in FIGS. 2 and 4. At the opposite end of lower plate 18, as shown in FIG. 5, the edge of the lower plate may extend beyond the notch portion 15*b*, FIG. 5, of the upper plate 15, so as to be clamped between the ledges formed by housing projections 26 and 27, FIG. 5.

Figure 5:
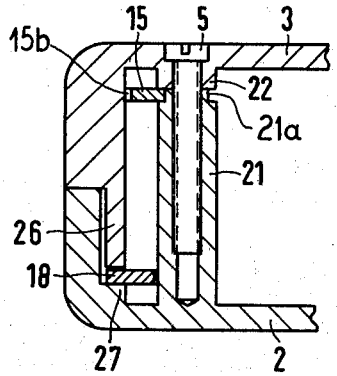
FIG. 5 shows a cross-section along line III—III in FIG. 2.
Figure 7:
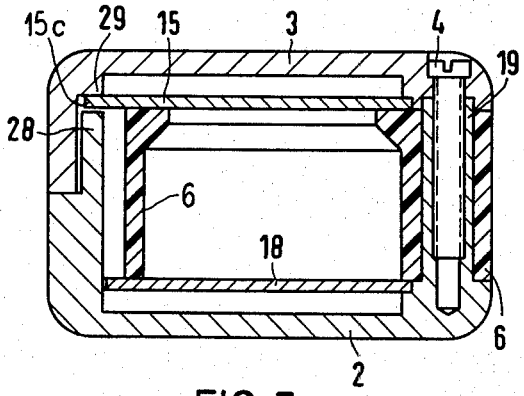
FIG. 7 shows a cross-section along line V—V of FIG. 2.

Similarly the upper plate 15 is notched in conformity to surface 20*a*, FIG. 2, in the vicinity of screw 4; is notched in conformity to boss 21*a*, FIG. 5, in the vicinity of screw 5; and has an edge portion 15*c*, FIGS. 2 and 7, near screw 23, where the upper plate 15 is clamped between housing projections 28 and 29, FIG. 7.

Accordingly each of the plates 15 and 18 is locked into a parallel conforming relation to the other plate by means of confronting ledges at three spaced locations about the edge of the plate, specifically for plate 15 at 6*a*, 20 at screw 4, FIG. 3; at 22, 31, FIG. 3, at screw 5; and at 28, 29, FIG. 7, near screw 23; and for plate 18, at 6*b*, 30, FIG. 3, at screw 4; at 24, 25 at screw 23, FIG. 4; and at 26, 27, FIG. 5 near screw 5. Confinement of the plates against edgewise displacement (in the planes of the plates) is provided by the notched regions about the edge of plate 15 at 20*a*, FIG. 2, 21*a*, FIG. 3; and at 15*a*, FIG. 2; and by the notched regions about the edge of plate 18 at 19*a*, FIG. 4; at 18*a*, FIG. 3; and at 25*a*, FIG. 4; which notched regions are on three respective sides of the plates.

I claim as my invention:

1. A miniature hearing aid device which is worn on the head, said device comprising a microphone, an ear piece receiver, a housing comprising first and second housing parts, an amplifier between said first and second housing parts of said housing, said amplifier being fastened in said housing, characterized in a plurality of plates in said housing, the amplifier having elements thereof arranged distributed on the plurality of plates, and opposite walls of the housing having spacer support projections supporting the plates in spaced superimposed relation, and characterized in that the projections provide ledges at the opposite walls of the housing parts having support surfaces for determining the position of the plates; in that the edges of the plates have recesses which allow the projections for the respective other plate to pass by; and in that the projections in the second housing part engage on the plates as counter-support to the projections of the first housing part when said second housing part is attached to the first housing part.

2. A miniature hearing aid device which is worn on the head, said device comprising a microphone, an ear piece receiver, a housing comprising first and second housing parts, an amplifier between said first and second housing parts of said housing, said amplifier being fastened in said housing, characterized in a plurality of plates in said housing, the amplifier having elements thereof arranged distributed on the plurality of plates, and opposite walls of the housing having spacer support projections supporting the plates in spaced superimposed relation, and characterized in that two plates have all of the elements of said amplifier distributed thereon, each housing part comprising a housing shell, three respective projections being present in each shell, the housing shells being of cooperating configuration to enclose said plurality of plates therebetween, at least two pairs of the projections of the respective shells being aligned with each other and having aligned bores, and screw thread means extending through the aligned bores of the respective pairs of projections of the respective shells for securing the shells together with said plates supported by said projections within the enclosure formed by said shells.

3. A miniature hearing aid device which is worn on the head, said device comprising a microphone, an ear piece receiver, a housing comprising first and second housing parts, an amplifier between said first and second housing parts of said housing, said amplifier being fastened in said housing, characterized in a plurality of plates in said housing, the amplifier having elements thereof arranged distributed on the plurality of plates, and opposite walls of the housing having spacer support projections supporting the plates in spaced superimposed relation, and characterized in that the battery holder is seated between two plates carrying the amplifier so as to function as a spacer support.

4. A device according to claim 3, characterized in that, with two plates carrying the amplifier, a battery contact is attached to each such plate.

* * * * *